US010702118B2

(12) United States Patent
Mazzone et al.

(10) Patent No.: US 10,702,118 B2
(45) Date of Patent: Jul. 7, 2020

(54) LUSTERING PLATE FOR A PORTABLE ELECTRIC ROTARY MACHINE

(71) Applicants: Libero Mazzone, Grateloup (FR); Michel Barberis, Saint André de la Roche (FR); Antonio Greco, Nice (FR)

(72) Inventors: Libero Mazzone, Grateloup (FR); Michel Barberis, Saint André de la Roche (FR); Antonio Greco, Nice (FR)

( * ) Notice: Subject to any disclaimer, the term of this patent is extended or adjusted under 35 U.S.C. 154(b) by 275 days.

(21) Appl. No.: 15/768,910

(22) PCT Filed: Dec. 20, 2017

(86) PCT No.: PCT/FR2017/053750

§ 371 (c)(1),
(2) Date: Apr. 17, 2018

(87) PCT Pub. No.: WO2018/122500

PCT Pub. Date: Jul. 5, 2018

(65) Prior Publication Data

US 2020/0146526 A1 May 14, 2020

(30) Foreign Application Priority Data

Dec. 30, 2016 (FR) ..... 16 63550
Dec. 20, 2017 (WO) ..... PCT/FR2017/053750

(51) Int. Cl.

| | |
|---|---|
| ***A47L 11/03*** | (2006.01) |
| ***B24B 23/02*** | (2006.01) |
| ***B24B 29/00*** | (2006.01) |
| ***B24B 57/02*** | (2006.01) |
| ***A47L 13/17*** | (2006.01) |

(52) U.S. Cl.
CPC ..... *A47L 13/17* (2013.01); *B24B 23/02* (2013.01); *B24B 29/00* (2013.01); *B24B 57/02* (2013.01)

(58) Field of Classification Search
CPC ..... A47L 13/17; B24B 23/02; B24B 29/00; B24B 57/02
See application file for complete search history.

(56) References Cited

U.S. PATENT DOCUMENTS 4,102,084 A * 7/1978 Bloomquist ..... B24B 23/03 451/295
4,383,345 A * 5/1983 Alexander ..... B24B 23/02 15/29
4,484,419 A * 11/1984 Freerks ..... B24D 15/04 451/450
4,796,321 A * 1/1989 Lee ..... A46B 13/04 15/29

* cited by examiner

*Primary Examiner* — Dung Van Nguyen
(74) *Attorney, Agent, or Firm* — Renner Kenner Grieve Boback Taylor and Weber

(57) ABSTRACT

Lustering plate (1) formed from a foam body (2), endowed with a securing surface (21) to be secured to the rotary plate of a lustering machine and having an active surface (22) wetted with the lustering liquid and coming into contact with the surface to be lustered. The lustering plate (1) incorporates a reservoir of lustering liquid (3) incorporated into the foam body (2). The reservoir (3) has a dispensing valve (4) in the axial position dispensing onto the active surface (22). The valve (4) has a valve seat (41) closed by a blocking device (43) returned to the closed position and endowed with a control device (44) opening the valve (4) by impelled pressing of the foam body (2) via its active surface (22) against the surface to be lustered.

5 Claims, 3 Drawing Sheets

LUSTERING PLATE FOR A PORTABLE ELECTRIC ROTARY MACHINE

DOMAIN OF THE INVENTION

The invention herein pertains to a lustering plate formed from a foam body, endowed with a securing surface to be secured to the rotary plate of a lustering machine and having an active surface wetted with the lustering liquid and coming into contact with the surface to be lustered.

STATE OF THE ART

Such lustering plates are already known.

Since, for lustering, one needs not only a surface that is rubbed against the surface to be lustered but also a liquid that is drawn along by the tool's active surface for lustering the surface. This liquid contains a charge of finely-divided material that is the principal active ingredient for the lustering. One needs a lustering liquid having particular characteristics, depending on the surface to be lustered, as well as a lustering plate suitable for the lustering liquid.

Lustering liquids are supplied in relatively large quantities to professionals, meaning that often a part of these large quantities are the remains of one or more operations that become unusable because of deteriorations in the liquid.

This constitutes a major and costly waste of lustering liquid.

PURPOSE OF THE INVENTION

The purpose of the invention herein is to develop a lustering plate that is practical, and that simplifies the preparatory operations and reduces the wastage of the lustering liquid, both during the lustering and in terms of remainders of unconsumed lustering liquids.

Explanation and Advantages of the Invention

For this purpose, the invention herein addresses a lustering plate of the type specified above, characterized by the fact that the lustering plate incorporates:

- a reservoir of lustering liquid built into the foam body;
- with the said reservoir having a dispenser valve in the axial position dispensing onto the active surface of the foam body;
- with the valve having a valve seat closed by a blocking device returned to the closed position and endowed with a control device that opens the valve under impelled pressing of the foam body by its active surface against the surface to be lustered.

The incorporation of the reservoir containing the lustering liquid into the lustering considerably simplifies the work of lustering and the management of stocks of equipment. This is because the operative chooses the lustering disc as a function of each application, and then has an average quantity of lustering liquid for such an operation. The liquid is dispensed directly onto the active surface during the work, because the operative simply presses the lustering disc against the worked surface and a dose of lustering liquid is dispensed from the reservoir and valve and arrives on the active surface. Since this dose is easily managed by the duration of mechanical contact of opening of the valve, the user can, with practice, very easily manage the dispensation of lustering liquid. Because the liquid arrives on the lustering surface at the center of the plate, there are practically no ejections of the product. It also means that all the product dispensed will be used for the lustering.

According to another advantageous characteristic, the valve control device is a rod connected to the blocking device, and is pushed back in the direction of opening by the compression of the foam body by its active surface pressing against the surface to be lustered.

This control device constitutes a very simple means of controlling the opening of the valve and dispensing the lustering liquid in a measured manner.

According to another advantageous characteristic, the valve incorporates a return spring. The valve is maintained closed by the return spring, and it is only when the control device—namely the rod—is pushed back by its arrival against the surface to be lustered or against an intermediate surface that the valve is operated. When the compression is no longer applied, the return spring closes the valve again.

According to another advantageous characteristic, the valve is maintained in the closed position by a magnetic connection that presses the blocking device against the valve seat, with this connection being constituted by for example—a magnetic system such as a magnet incorporated into the valve, and with the valve seat incorporating a ferromagnetic part such as a ring, so as to attract the blocking device against the valve seat and close the valve.

According to another characteristic, the reservoir is reloaded via a filling aperture positioned within the center line of the securing surface.

Overall, the entire lustering plate—including the reservoir and the components or accessories of the reservoir, such as the distribution valve—is composed of components centered around the axis of rotation, which is also the axis of symmetry of the lustering plate, so as to prevent any imbalance and to endow a regular rotation of the lustering plate, which is essential for the quality of the lustering work.

DRAWINGS

The invention herein is described hereafter in greater detail, by means of two forms of implementation of a lustering plate, such as illustrated in the appended drawings, in which.

DESCRIPTION OF FORMS OF IMPLEMENTATION OF THE INVENTION

Figure 1:
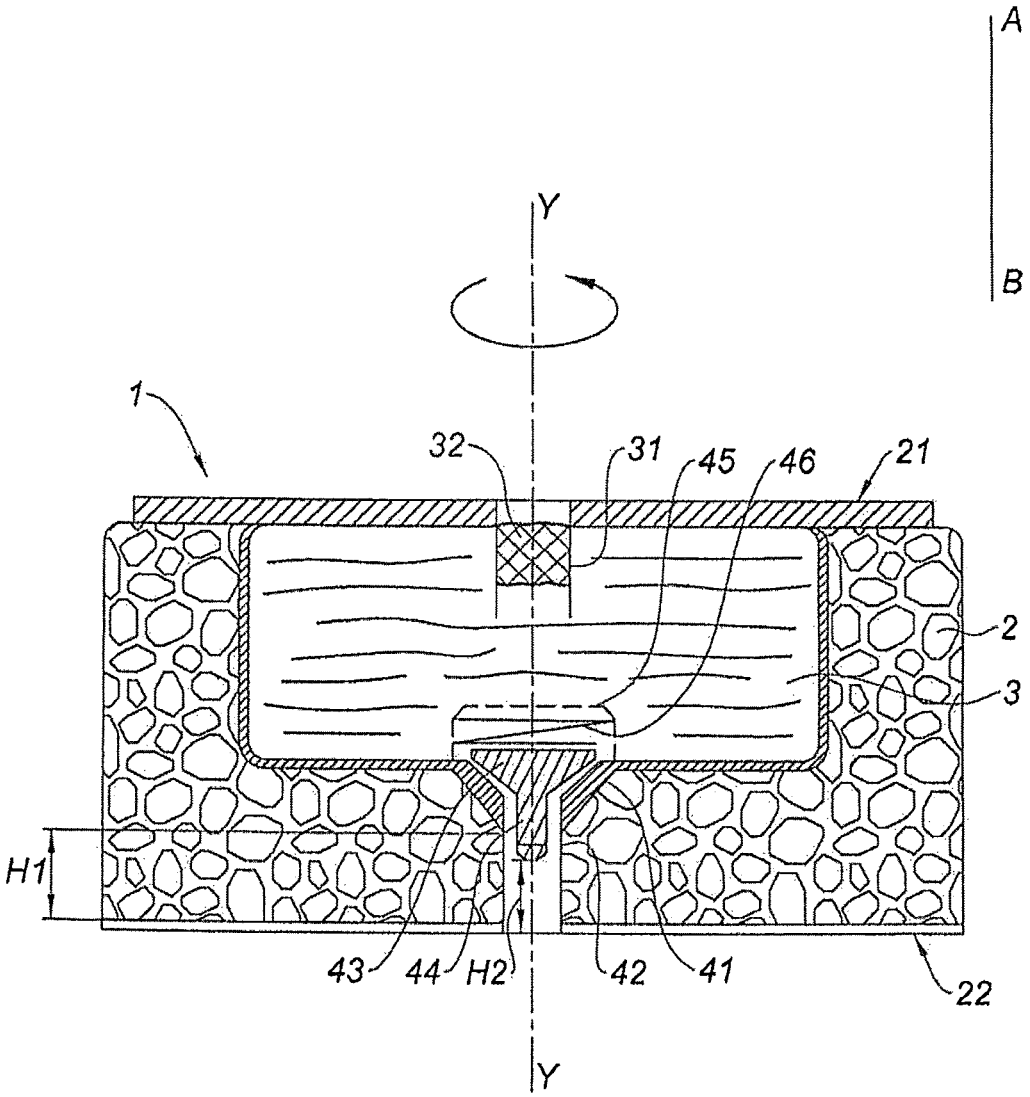
FIG. 1 is an axial cross-section of one form of implementation of a lustering plate.
Figure 4:
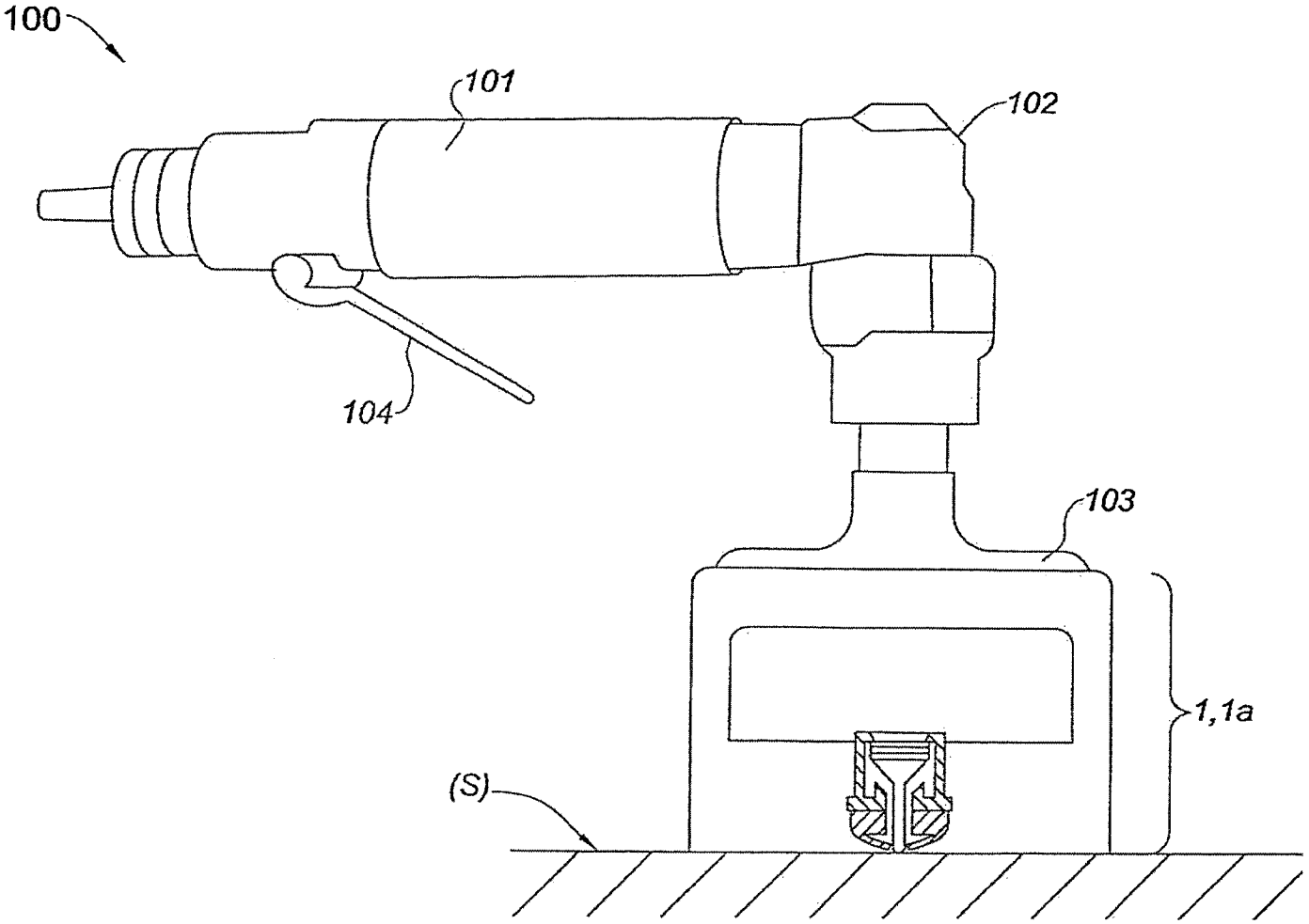
FIG. 4 is an extremely-simplified schematic of a lustering machine equipped with a lustering plate according to the invention.

In FIG. 1, the invention addresses a lustering plate (1) that is secured to the tool-bearing rotary plate (103) of a portable electric rotary machine (100) driving the rotation of the lustering plate (1) in a simple rotation movement or an orbital movement on a surface to be lustered (worked surface) (S) using a lustering liquid. Such a machine is illustrated in FIG. 4.

The lustering plate (1) is composed of a body (2) of circular disc form, made of foam, of which one face incorporates a securing surface (21) for the plate (103) of the rotary machine (100), while the other face constitutes the active surface (22) used for the lustering. The foam body (2)

incorporates a reservoir for lustering liquid (3). The reservoir (3) is endowed with a dispensing valve (4) in the lower wall, at the center (according to the orientation T/B [top/bottom] in FIG. 3).

The valve (4) incorporates a valve seat (41) opening into a pipe (42) positioned within the foam or composed by a flexible sleeve, over at least part of the height (H1), as from the active surface (22), under the seat (41). A blocking device (43) of a cone shape that complements the shape of the seat (41), is pressed elastically against it—for example, by means of a spring (46) pressed, firstly, against the top of the blocking device (43) and, secondly, against a pressure point (44) integral with the reservoir or the valve seat (41)—for example, in the form of a bow or strainer above the valve seat (41). The blocking device (43) is extended within the pipe (42) by a rod (44) arriving above the active surface (22) not compressed at the height (H2), such that if one compresses the foam to a height (H1), at the extremity of the rod (44), which will be touched and pushed back, opening the valve (4) and releasing the lustering liquid.

According to the form of implementation in FIG. 1, the top of the reservoir (3) is directly under the securing surface (21), and is only surrounded by foam laterally and below.

The valve (4), with its blocking device (43), its spring (46) and its pressure point (44), is a part manufactured separately and then incorporated into the reservoir (3). In the case of a disposable lustering plate, the filling is performed at the end of manufacturing the plate, via the valve (4), which is then protected to prevent its being operated accidentally during the packaging and transportation operations.

In the form of implementation in FIG. 1, the reservoir (3) has a filling aperture (31) on the securing surface (21) side, closed by a plug (32).

The securing surface (21) of the plate is preferably a fibrous surface designed to affix itself to the surface of the plate (103) of the machine (100), the which machine is generally equipped with small claws allowing quick securing while being, notwithstanding, highly effective without subsequently impeding the replacement of the lustering plate (1) after use.

The active surface (22) of the plate (1) is the bottom surface of the foam body (2) or a special added surface. The active surface (22) has a roughness and, more generally, a surface condition that depends on the work to be performed and the nature of the surface to be worked/lustered. The same applies to the quality of the lustering liquid. The control rod (43) stops cleanly above the active surface (22) at rest, when the foam body (2) is not compressed, so as not to systematically open the dispenser valve (4) during the lustering work, and so that liquid is only dispensed via an intentional action resulting from a pronounced pressing of the lustering plate (1) on the worked surface (S).

In the case of a valve (4) incorporating a pipe (42), it is flexible and slightly distant from the active surface (22), so as not to intervene in the lustering while, nonetheless, enabling the compression of the foam body (2).

It is also necessary that the valve (4) should remain impermeable and not be likely to be opened by an accidental pressure exerted on the control rod (44) during the operations of packaging, handling and installation of the plate (1) on the machine (100).

In a variant not illustrated, the valve's control rod is added such that it can be installed at the time of usage of the plate, via being screwed or clipped on.

In another variant, the return spring (45) of the blocking device (43) is replaced by a magnetic connection system consisting of a small magnet incorporated into the blocking device and a ferromagnetic ring incorporated into the valve seat (41).

It should also be noticed that the complete lustering plate must have a symmetry of rotation, with a precise distribution of the weight around the axis YY, which is the axis of rotation of the machine, to prevent any imbalance. For this reason, the entire structure of the lustering plate (1) has a symmetry of rotation.

Figure 2:
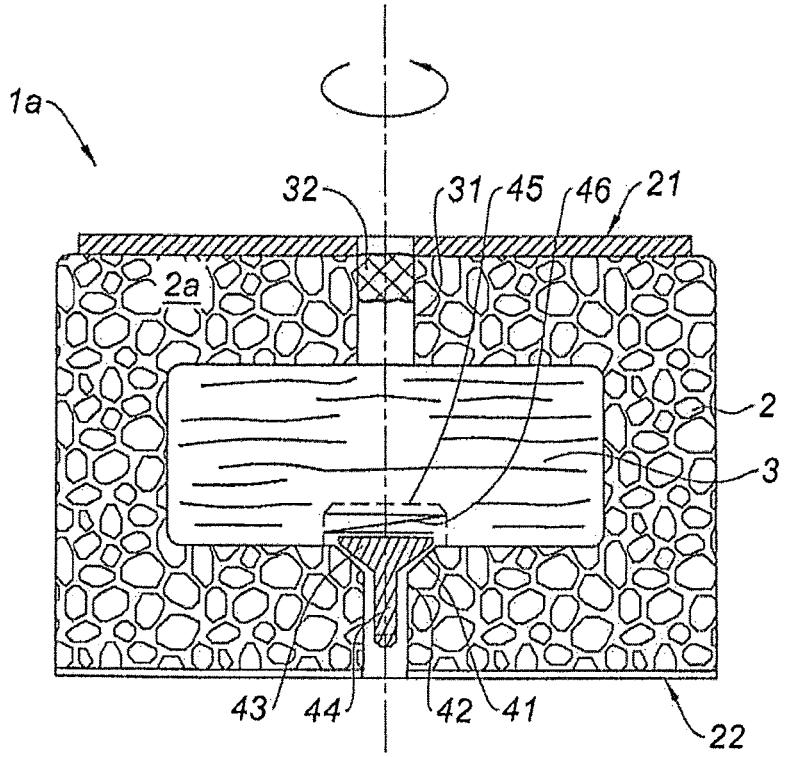
FIG. 2 shows an axial cross-section of a second form of implementation of a lustering plate.

FIG. 2 shows another form of implementation of the lustering plate (1*a*) in which the parts that are identical to those of the form of implementation in FIG. 1 have the same references. This form of implementation differs from the preceding one insofar as the reservoir (3) is incorporated more deeply into the foam body (2) of the lustering plate (1*a*), with an intermediate foam part (2*a*) between the top of the reservoir (3) and the securing surface (21) of the machine's (100) drive plate. As regards the remainder, the characteristics of this lustering plate are the same as those of the preceding plate.

Figure 3:
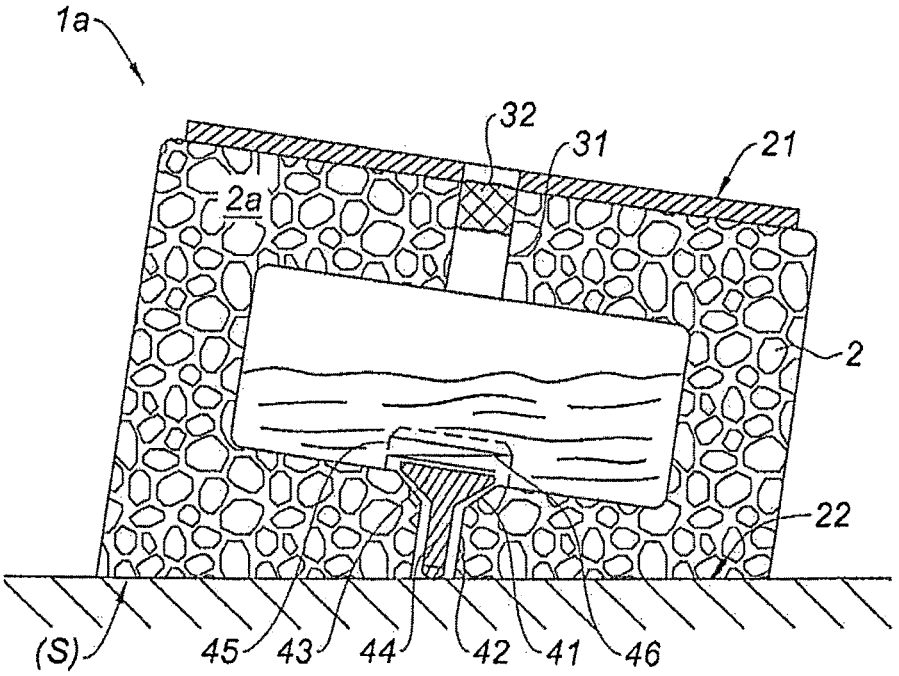
FIG. 3 shows an example of active positioning of lustering liquid dispensation in the case of the plate in FIG. 2.

FIG. 3 shows the lustering plate (1*a*) of FIG. 2 positioned to distribute the lustering liquid. In the represented position, the lustering plate (la) is—for example—inclined and the bottom, at the active surface (22) is compressed such that the blocking device (43) is lifted from the valve seat (41), and the lustering liquid is thus dispensed through the pipe (42) on the active surface (21), which is the interface between the lustering plate (1*a*) and the lustering surface (S). This inclined position of actuation of the blocking device (43) is only an example; it is also possible to compress the foam body (2) by compressing it perpendicularly to the worked surface (S).

In the case of the form of implementation of FIG. 1, the dispensing of lustering liquid occurs under the same conditions, whether the plate (1, 1*a*) is inclined or parallel to the surface to be lustered (S). In addition, it should be noticed that the surface to be lustered (S) is not necessarily flat or horizontal.

FIG. 4 provides a schematic illustration of a portable electric machine (100) equipped with a tool-holder plate (103) and a lustering plate (1, 1*a*) in accordance with the invention. The machine is composed of a sleeve forming a handle (101) enclosing the electric motor. The output point of the motor impels—via an angular point (102), such as a 90° angle—the output shaft bearing the plate (103) accommodating the lustering plate (1, la).

PARTS LIST

1, 1*a* Lustering plate
2 Foam body
21 Securing surface
22 Active surface
2*a* Intermediate particular
3 Reservoir
31 Filling aperture
32 Plug
4 Dispensing valve
41 Valve seat
42 Pipe
43 Blocking device
44 Control rod of the blocking device
45 Pressure point, bow/strainer
46 Spring
100 Portable electric machine
101 Handle accommodating the electric motor
102 Angular point

103 Tool-holder plate
104 Control handle
S Surface to be worked/lustered
YY Axis of rotation and symmetry of the plate
H1 Height of the deformable part of the channel
H2 Height of the extremity of the control rod in relation to the active surface

The invention claimed is:

1. Lustering plate composed of a foam body, endowed with a securing surface to be secured to the rotary plate of a lustering machine, having an active surface wetted by the lustering liquid and coming into contact with the surface to be lustered (S); lustering plate characterized by the fact that it incorporates:

a reservoir (3) of lustering liquid built into the foam body (2);

with the said reservoir (3) having a dispenser valve (4) in the axial position dispensing onto the active surface (22) of the foam body (2);

with the valve (4) having a valve seat (41) closed by a blocking device (43) returned to the closed position and endowed with a control device (44) that opens the valve (4) under impelled pressing of the foam body (2) by its active surface (22) against the surface to be lustered (S).

2. Lustering plate in accordance with claim 1, characterized by the fact that the control device of the valve (4) is a rod (44) connected to the blocking device (43), that is pushed back in the direction of opening by the compression of the foam body (2) by its active surface (22).

3. Lustering plate in accordance with claim 1, characterized by the fact that the valve (4) incorporates a return spring (46) pressed against the blocking device (43), pushed against the seat (41).

4. Lustering plate in accordance with claim 1, characterized by the fact that the blocking device (43) is returned against the valve seat (41) by a magnetic connection.

5. Lustering plate in accordance with claim 1, characterized by the fact that the reservoir (3) has a filling aperture (31) positioned within the center line (YY) of the securing surface (21), to enable its reloading.

* * * * *